US005226451A

United States Patent [19]

Brumfield

[11] Patent Number: 5,226,451

[45] Date of Patent: Jul. 13, 1993

[54] FLOW SELECTOR VALVE

[76] Inventor: James W. Brumfield, 1895 Birch Ave., Richland, Wash. 99352

[21] Appl. No.: 962,135

[22] Filed: Oct. 16, 1992

[51] Int. Cl.[5] ..... E03B 1/00

[52] U.S. Cl. ..... 137/625.11; 251/129.11; 251/266; 251/216; 251/218; 251/252

[58] Field of Search ..... 137/625.11, 625.48, 137/625.49, 625.42, 625.46; 251/129.11, 129.12, 264, 266, 274, 325, 216, 218, 252

[56] References Cited

U.S. PATENT DOCUMENTS

| | | | |
|---|---|---|---|
| 2,858,850 | 11/1958 | Arenson | 137/625.11 |
| 3,162,210 | 12/1964 | Bemis | 137/625.11 X |
| 3,331,384 | 7/1967 | Moore | 137/625.11 X |
| 3,678,959 | 7/1972 | Liposky | 137/625.11 |
| 3,765,461 | 10/1973 | Keck | 137/625.11 X |
| 4,231,547 | 11/1980 | Manfroni | 251/210 |
| 4,611,617 | 9/1986 | Hewitt | 137/68.1 |
| 4,771,982 | 9/1988 | Bodine et al. | 251/129.1 |
| 4,869,458 | 9/1989 | Susini et al. | 251/14 |

*Primary Examiner*—John Rivell

*Attorney, Agent, or Firm*—Wells, St. John, Roberts, Gregory & Matkin

[57] ABSTRACT

A flow selector valve is described in which a valve housing with a central bore is provided. The housing includes a plurality of axially spaced discharge openings and an intake opening openly communicating with the central bore. An elongated spool member, complementary to the central bore of the valve housing is slidably mounted in the central bore for axial movement therein. The spool member includes an internal chamber extending axially from a closed end within the spool member to an open end. The open spool end is in open communication with the intake opening of the housing. The spool member also includes at least one gate opening between the external spool surface and its internal chamber. A driver is connected to the spool member for selectively moving the spool member axially within the bore. The gate opening is movable between (a) a closed condition wherein the discharge openings are closed by the external surface of the spool member and (b) an open condition where the gate opening is aligned with a selected one of the discharge openings to thereby provide a flow path through the valve from the intake end through the selected one of the discharge openings.

15 Claims, 4 Drawing Sheets

FLOW SELECTOR VALVE

TECHNICAL FIELD

The present invention relates to valves and more particularly to a flow selector valve having multiple discharges openings and a spool for selectively controlling discharge through the openings.

BACKGROUND OF THE INVENTION

In water and other fluid flow systems, it is fairly common to use a number of valves, one for each circuit or branch where independent control of flow is desired. Lawn irrigation is a good example, where numerous groups of sprinkler heads are separated into branch lines in order to match flow capability with a proper number of sprinkler heads. In such systems, individual branch lines are connected to a manifold of valves, one for each branch. Such individual valves require separate operators, mechanical or electrical, and individual connection hardware for connection to the manifold. This is both expensive, due to the duplicitous nature of the components, and time consuming in installation and maintenance.

A need therefore exists for a single valve that will accommodate a number of discharge branches or circuits and that requires only a single control or driver for operation.

The present valve solves the above problems by providing a multiple discharge, single intake valve with a single spool arranged within the valve housing for sequentially opening and closing the multiple discharges using a single driver. The spool can be moved selectively by a single driver to open and close successive discharge openings therein.

BRIEF DESCRIPTION OF THE DRAWINGS

Preferred embodiments of the invention are described below with reference to the accompanying drawings, which are briefly described below.

FIG. 6 is an enlarged sectional view of the present valve with an alternate driver arrangement.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
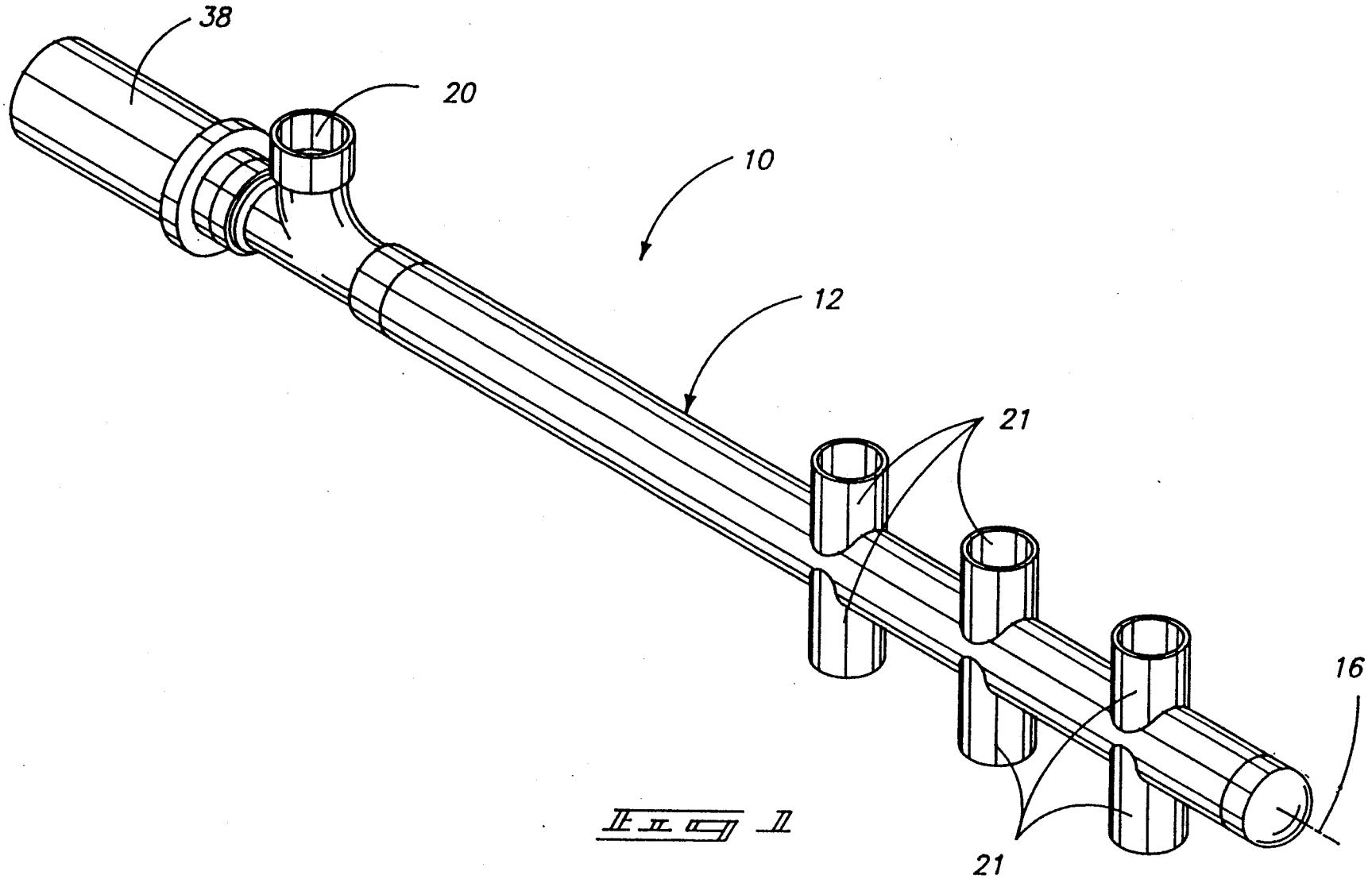
FIG. 1 is a perspective view of a valve including features of a first preferred form of the present invention.
Figure 2:
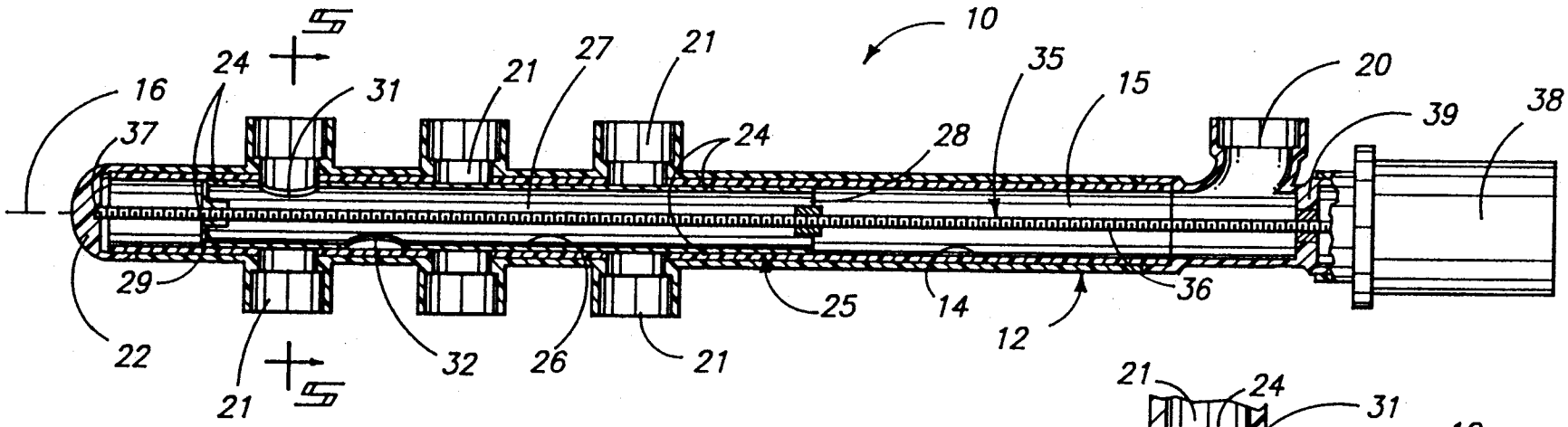
FIG. 2 is a longitudinal sectional view taken through the first preferred form of the present valve.
Figure 4:
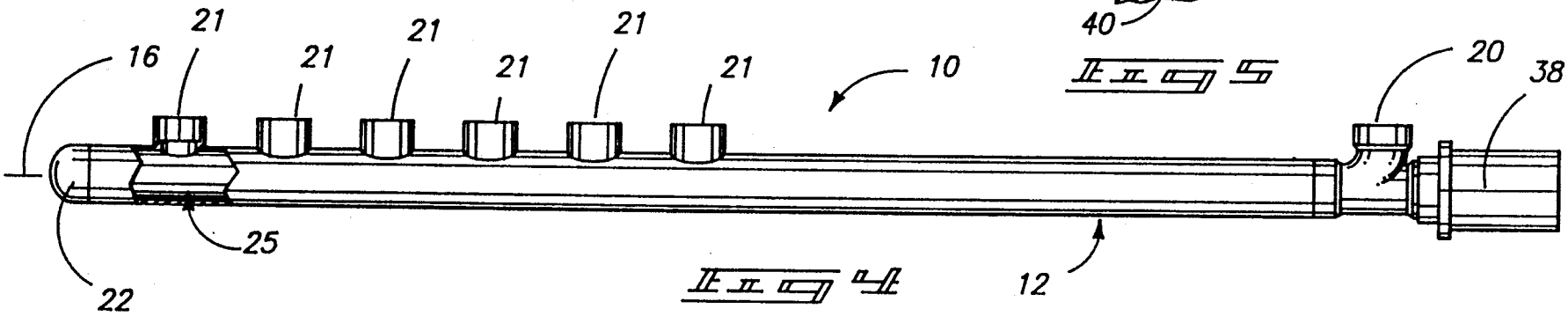
FIG. 4 is a side elevation view of a second preferred form of the present invention.
Figure 3:
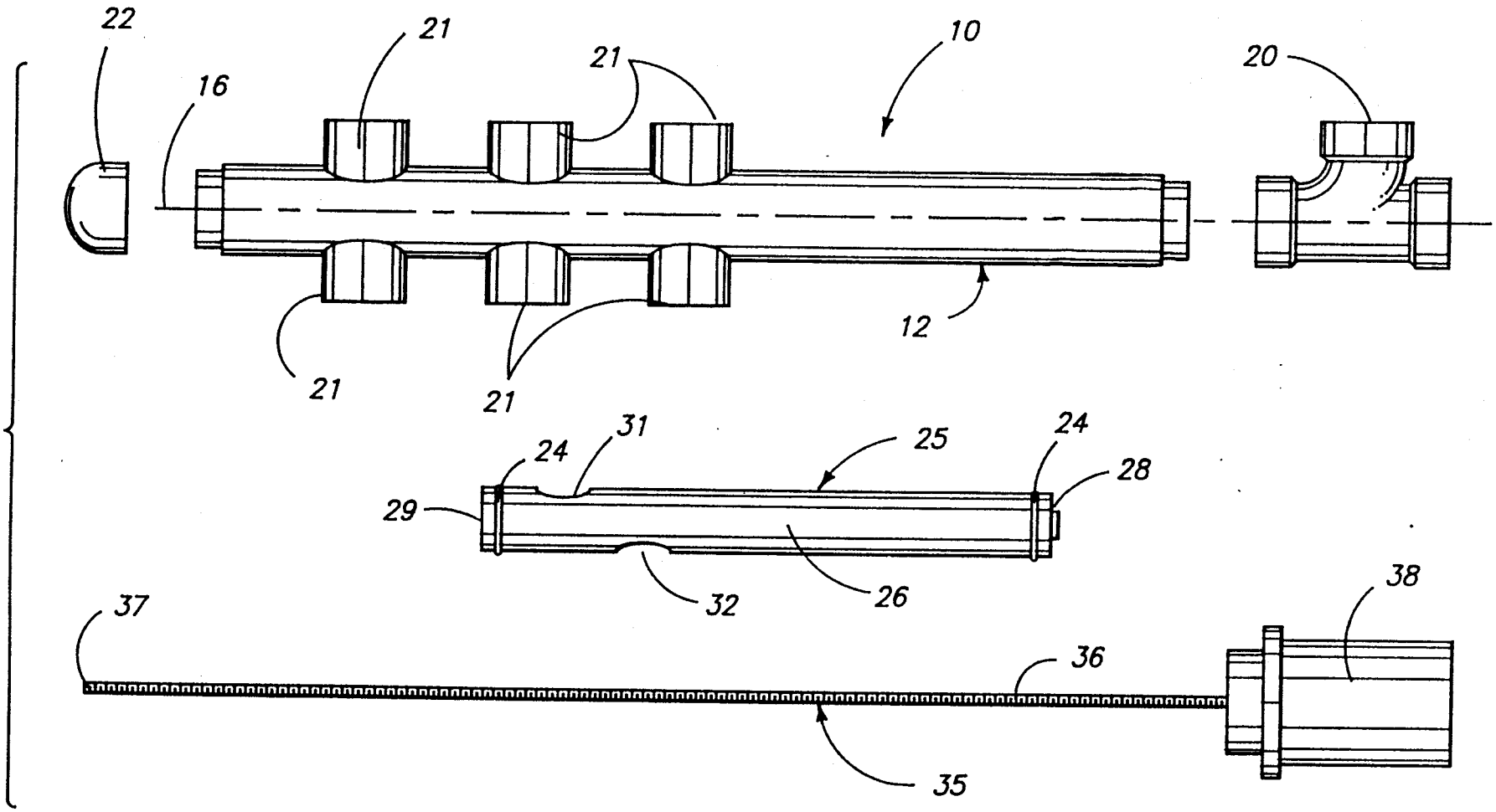
FIG. 3 is an exploded elevational view of the valve of the first preferred form.
Figure 5:
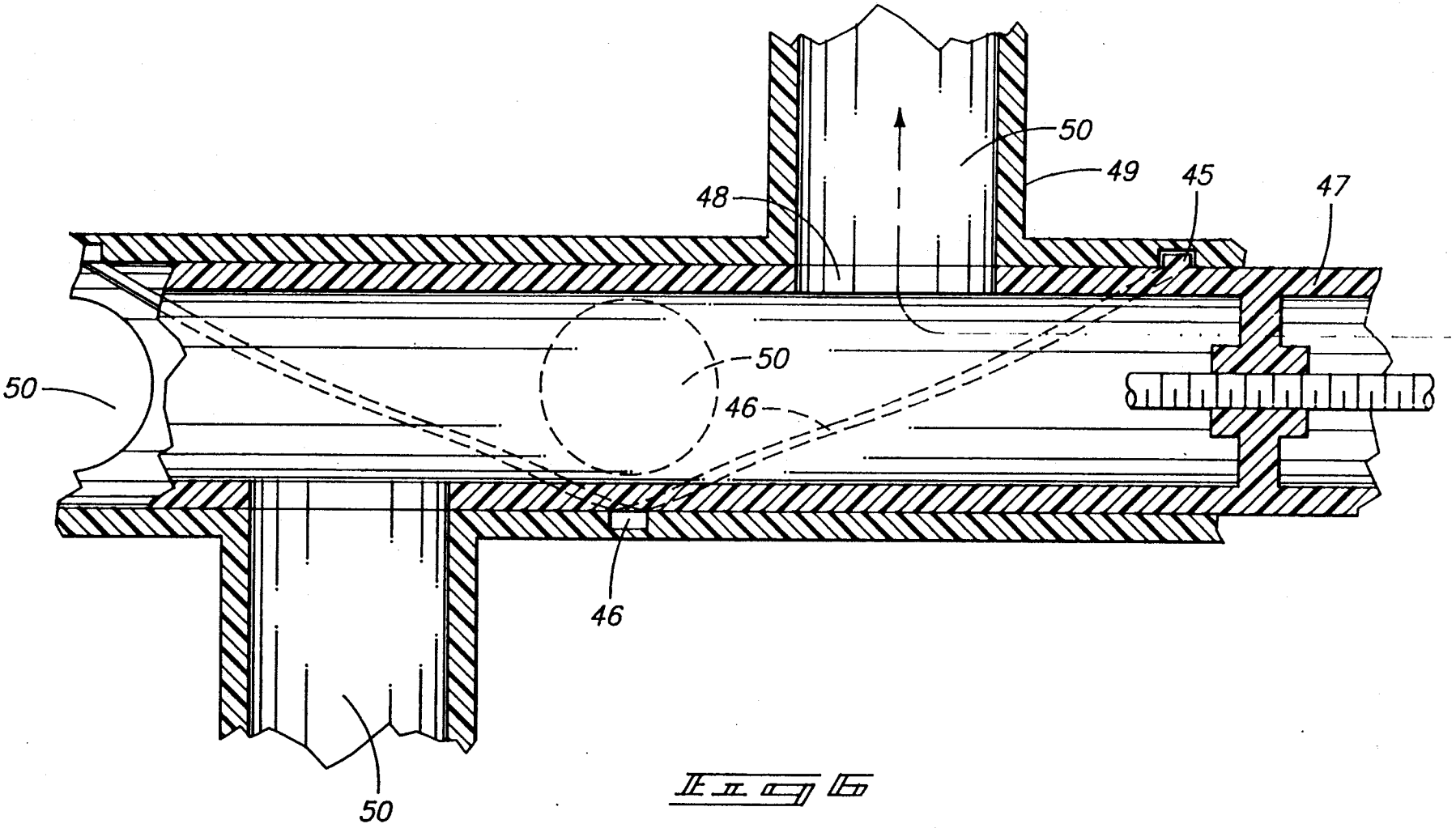

Two examples of preferred forms of the present invention are shown in the accompanying drawings. A first preferred form is illustrated in FIGS. 1-3, while a second exemplary form is shown in FIG. 4. Since both forms include similar elements, both will be described simultaneously, using the same reference numerals to identify similar if not identical elements.

The present valve is generally shown in the drawings by the reference numeral 10. Its intended use is to connect a source of fluid (not shown) to any one of a number of delivery branches (also not shown), and to be selectively operated to deliver fluid from the source to any one of the delivery branches.

The present valve 10 includes a housing 12 which may be formed of injection molded synthetic resin (such as polyvinylchloride), or another material commonly used in valve construction, such as cast and machined brass. The housing is elongated, and includes a central longitudinal bore 14.

The bore 14 is cylindrical, as shown in the preferred examples illustrated, and as defined by an internal surface bore surface 15. The bore 14 extends along a longitudinal central first axis 16 from an intake end of the housing including an intake opening 20, past a successive number of discharge openings 21, to a closed end 22.

The intake opening 20 and discharge openings 21 all open into the bore 14 from longitudinally spaced positions along the length of the housing. The discharge openings 21 are all situated downstream in terms of fluid flow through the valve, from the intake opening.

It is pointed out that the intake and discharge openings are interchangeable. That is the intake opening could be utilized as a discharge opening. Likewise, the discharge openings 21 could be utilized as individual intake openings. If reversed as described, the present valve could easily be utilized to connect several different sources of fluid through several intake openings to the single discharge opening.

Still further, it is entirely conceivable that there be several intake and several discharge openings. This capability will become evident from the construction shown and further described below.

In the first preferred form, the discharge openings are provided in pairs, with each opening 21 of a pair being angularly offset from the other opening of the pair about the first axis 16. The discharge openings of each pair are oriented in a single plane that is substantially transverse to the first axis 16, as clearly understood from FIG. 2 of the drawings. The successive pairs of discharge openings are equally spaced apart along the first axis 16.

In the second preferred form, individual discharge openings 21 are also equally spaced from one another, and are aligned along the first axis 16.

In both exemplary forms, the housing may be provided with standard, conventional fittings or coupling members for receiving and securing piping or other desired conduit to the intake and discharge openings.

An equal number of discharge openings are shown for both embodiments. However, it should be understood that fewer or more discharge openings could be provided in either form.

A spool 25 is movably mounted within the bore. The spool 25 includes an external surface 26 that is complementary to but slightly smaller in diameter than the bore 14. The spool 25 will thus slide relatively freely within the bore 14, but will not allow passage of fluid into the space between the spool external surface 26 and the internal surface 15 of the housing that defines the bore 14.

The spool may also be constructed of injection molded synthetic resin, or another commonly used material used in the valving arts, such as brass or steel.

Additionally, "o" rings 24 may also be provided to assure a sealed relationship between the two surfaces.

The spool is elongated, including a length dimension greater than the axial dimension along the housing occupied by the discharge openings 21. Thus, the spool is longer than the dimension along the axis 16 between the discharge opening spaced furthest from the intake opening 20 and the discharge opening spaced closest to the intake opening.

The spool 25 includes an internal chamber 27 that extends from an open spool end 28, to a closed spool end 29. The open spool end 28 openly communicates with the housing bore 14 and is situated axially between the closed end 29 and the housing intake opening 20. The area of the bore axially between the closed spool end 29 and the closed housing end 22 is thus effectively sealed.

The spool of the first preferred form includes two axially spaced gate openings 31, 32. Openings 31, 32 extend substantially radially through the wall of the spool from the external surface 26 to open into the spool internal chamber 27. They are advantageously similar in size to the discharge openings 21 of the housing 12.

The openings are angularly spaced about a central spool axis (that is advantageously coaxial with the first axis 16) through the same angle spacing as the angular spacing between the discharge openings 21. The openings 31, 32 are thus aligned along the axis 16 with the discharge openings 21. The preferred angle shown is approximately 180 degrees, but could be other angles as desired, so long as the angular relationship between the discharge openings and the gate openings remains similar.

The axial spacing between the gate openings 31, 32 is approximately half of the axial distance between successive discharge openings 21. Thus when one gate opening is moved into axial alignment with a selected discharge opening, as shown in FIG. 2, the other gate opening will be closed by the internal housing surface 15.

In the second preferred form of the present valve 10, the spool need only include a single gate opening, since all discharge openings 21 are axially aligned. Here again the spool will have a length dimension greater than the axial dimension between the two end discharge openings of the group. The spool will otherwise be identical to the spool shown in FIGS. 2 and 3.

The spool is moved axially within the housing bore 14 by a driver, shown generally at 35. The driver is connected to the spool to move the spool axially within the housing and bring successive discharge openings 21 into open communication with one or another gate opening.

The driver, in the preferred forms is comprised of an elongated threaded shaft 36, formed of a durable metal such as stainless steel or brass. The shaft 36 is connected through threaded openings in the spool and extends axially through the length thereof. An end of the shaft projects axially out from the housing through a bushing seal 39 for connection to a source of rotational power. Selective rotation of the shaft will thus result in axial movement of the spool within the housing.

Figure 5:
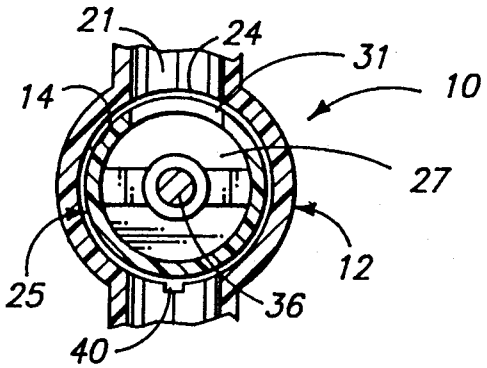
FIG. 5 which is an enlarged transverse sectional view taken along line 5-5 in FIG. 2.

To assure that the spool in the first preferred form will not rotate with the shaft 36, an appropriate key and keyway arrangement 40 (FIG. 5) may be provided between the spool 25 and housing 12. The key may be formed integrally with the "o" rings 24 to maintain the sealed condition between the spool and housing.

In another preferred form, (FIG. 6) a keyway 46 is formed in a spiral to guide the spool, having a single gate opening 48 and a key 45 riding in the spiral keyway 46, to simultaneously rotate and move axially. In this manner, the single gate opening 48 may be moved successively to axially and angularly spaced discharge openings 50 placed in its spiral path. This form allows for closer axial spacing of the discharge openings 50, and a more compact valve housing 49 construction.

In the preferred powered versions shown, a drive motor 38 may be drivingly connected to an end of the shaft 36 to selectively rotate the shaft and cause corresponding axial movement of the spool to open and close successive discharge openings 21. It is preferred that the shaft include a remote end 37 that is rotatably journalled in the closed end 22 of the housing. The motor may be controlled by conventional switching and timing mechanisms (not shown) that are not a part of the present invention.

Installation of the present valve may be accomplished simply by connecting the intake opening to a source of fluid, and connecting the discharges to selected outflow lines. In use for irrigation, for example, the intake opening would be connected to the main source of water supply, and the discharge openings would be connected to individual irrigation branch lines. The method of connection and forms of connectors may be conventional as well known in the plumbing and piping arts.

It is noted that the present valve eliminates the need to provide a manifold connection between the main intake and several independently operated conventional valves. This is a distinct advantage over conventional valving arrangements.

In operation, the driver is selectively operated to rotate, as by the drive motor 38 to move the spool 25 axially within the housing 12. Successive discharge openings 21 will thus be opened, one at a time to flow from the intake opening 20.

In the first preferred form, one gate opening 31 will successively move from one discharge opening to the next in axial alignment along the housing. The other gate opening will successively open discharge openings 21 axially aligned therewith. With the axial offset between the gate openings 31, 32 shown and described above, only one discharge opening 21 will be opened to flow at any given time. The remaining discharge openings will be closed off by the spool.

In the second preferred form, successive discharge openings will be opened, one at a time, to flow through the intake as the spool is moved axially within the housing.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A flow selector valve, comprising:

a valve housing member including a central bore formed along a first axis and including a plurality of discharge openings openly communicating with the central bore;

said housing member further including an intake opening communicating with the central bore and axially spaced from the discharge openings;

an elongated spool member having an external surface formed along a spool axis and complementary to the central bore of the valve housing, slidably mounted in the central bore for movement within the central bore along the first axis;

said spool member including an internal chamber extending axially from a closed end within the spool member to an open end, said open end being in open communication with said intake opening of said housing;

said spool member also including a gate opening extending laterally in relation to the spool from the external surface to open into the internal chamber; and a driver mounted to the valve housing member and connected to the spool member for selectively moving the spool member between (a) a closed condition wherein the discharge openings are closed by the external surface of the spool member and (b) an open condition with the gate opening therein in open communication with a selected one of the discharge openings to thereby provide a flow path through the valve from the intake opening through the selected one of the discharge openings.

2. A flow selector valve, as claimed by claim 1 wherein the bore is cylindrical and wherein the spool includes a complementary cylindrical external surface slidably received within the bore.

3. A flow selector valve, as claimed by claim 1 wherein the discharge openings are spaced apart axially and angularly about the housing members and wherein one of said members includes a spiral keyway and the other of said members includes a key follower, received within the spiral keyway, whereby operation of the driver will cause corresponding axial and rotational movement of the spool member to bring the gate opening to successive discharge openings.

4. A flow selector valve, as claimed by claim 1 wherein the driver includes a threaded shaft rotatably mounted to the housing and extending into the bore and the internal chamber of the spool, threadably engaging the threaded spool such that rotation of the threaded shaft will cause axial movement of the spool within the housing.

5. A flow selector valve, as claimed by claim 1 wherein the discharge openings are spaced apart axially along the housing.

6. A flow selector valve, as claimed by claim 1 wherein the discharge openings are spaced apart axially along the housing and are offset angularly about the first axis.

7. A flow selector valve, as claimed by claim 1 wherein the driver includes a threaded shaft extending axially through the housing and wherein the spool includes a threaded opening threadably receiving the threaded shaft.

8. A flow selector valve, as claimed by claim 1 wherein the housing includes a closed end and wherein the driver includes a threaded shaft extending axially through the housing and spool to an end journalled in the closed end of the housing; and wherein the spool includes a threaded opening threadably receiving the threaded shaft.

9. A flow selector valve, as claimed by claim 1 wherein the discharge openings are paired, with each pair of discharge openings being spaced angularly about the first axis by an angle of approximately 180 degrees.

10. A flow selector valve, as claimed by claim 1 wherein the discharge openings are provided in multiple pairs, with said pairs of discharge openings being spaced axially apart from one another along the first axis.

11. A flow selector valve, as claimed by claim 1 wherein the discharge openings are provided in multiple pairs with each discharge opening in a pair being spaced apart angularly about the first axis, and in a plane transverse to the first axis.

12. A flow selector valve, as claimed by claim 1 wherein the discharge openings are provided in pairs with the discharge openings in each pair being angularly spaced apart about the first axis;

wherein the pairs are spaced apart equally along the first axis;

wherein there are two gate openings in the spool, openly communicating with the internal chamber;

wherein the two gate openings are spaced apart axially by a distance approximately half the axial spacing between the discharge openings pairs; and wherein the two gate openings are spaced apart angularly about the first axis by an angle equal to the angle between the discharge openings of each pair.

13. A flow selector valve, as claimed by claim 12 wherein the driver is comprised of an elongated threaded shaft extending axially along the housing within the central bore therein and threadably engaging the spool such that rotation of the threaded shaft will result in axial movement of the spool within the central bore.

14. A flow selector valve, as claimed by claim 12 wherein the spool includes an axial length dimension greater than the axial dimension between the pairs of discharge openings.

15. A flow selector valve, as claimed by claim 12 wherein the pairs of discharge openings are located along a selected length segment of the housing, and wherein the spool includes a length dimension along the first axis greater than the selected length segment of the housing.

* * * * *